US006557312B2

(12) United States Patent
McGinnis

(10) Patent No.: US 6,557,312 B2
(45) Date of Patent: May 6, 2003

(54) PREFABRICATED-BUILDING TOWER FOUNDATION

(76) Inventor: Henry J. McGinnis, 7241 Martha La., Fort Worth, TX (US) 76112

( * ) Notice: Subject to any disclaimer, the term of this patent is extended or adjusted under 35 U.S.C. 154(b) by 2 days.

(21) Appl. No.: 09/939,243

(22) Filed: Aug. 24, 2001

(65) Prior Publication Data

US 2002/0023394 A1 Feb. 28, 2002

Related U.S. Application Data

(60) Provisional application No. 60/227,632, filed on Aug. 24, 2000.

(51) Int. Cl.[7] ..... H01Q 1/22; H01Q 1/12; E02D 27/00; E04H 12/00

(52) U.S. Cl. ..... 52/296; 52/40; 52/297; 52/79.9; 52/173.1; 248/519; 343/720; 343/874; 343/878; 343/890

(58) Field of Search ..... 52/40, 296, 297, 52/79.9, 173.1, 736.1, 726.4; 343/720, 874, 878, 890; 248/519, 678, 679

(56) References Cited

U.S. PATENT DOCUMENTS 1,002,051 A * 8/1911 Fessenden
1,116,111 A * 11/1914 Pfund
1,206,353 A * 11/1916 Millener
1,722,352 A * 7/1929 Rawley
2,184,940 A * 12/1939 Cork et al.
4,649,675 A * 3/1987 Moldovan et al. ..... 52/40 X
4,714,225 A * 12/1987 Skinner et al. ..... 248/523
4,951,433 A * 8/1990 Miller et al.
5,162,807 A * 11/1992 Ursenbach et al.
5,531,419 A * 7/1996 Gustafsson et al. ..... 248/519
5,904,001 A * 5/1999 Hill ..... 52/40
5,941,036 A * 8/1999 Hill ..... 52/292
6,435,468 B1 * 8/2002 Simchoni ..... 248/519

* cited by examiner

*Primary Examiner*—Robert Canfield
(74) *Attorney, Agent, or Firm*—Bracewell & Patterson, L.L.P.

(57) ABSTRACT

An easily-constructed foundation for an antenna support tower is provided that requires no fabricated support surface at the installation site. The foundation is a radial array of prefabricated buildings connected near their inner corners to each other. In a first embodiment, one leg of a multi-legged tower rests on each building, the buildings transferring forces from the tower to the support surface below the buildings. In a second embodiment, a tapered monopole tower is located in the center of the array of buildings. The monopole tower may rest on a prepared surface or may be supported above the support surface. Support structures, each having a central ring and radially extending arms, are attached at the building connection points, one support structure above the other. The monopole tower is positioned within the central ring, transferring lateral loads through the ring and arms to the buildings, negating the need for a moment base.

20 Claims, 2 Drawing Sheets

PREFABRICATED-BUILDING TOWER FOUNDATION

CROSS REFERENCE TO RELATED APPLICATIONS

This application claims the benefit of Applicant's copending U.S. provisional application, Ser. No. 60/227,632, filed on Aug. 24, 2000.

BACKGROUND OF THE INVENTION

1. Field of the Invention

The present invention relates in general to antenna support towers, and more particularly to antenna support towers having a foundation formed from prefabricated buildings.

2. Description of the Prior Art

Antenna support towers are tall, free-standing structures designed to carry communications antennae. The antennae are mounted at a height sufficient to provide broadcast capabilities over a large coverage area or for long distances for line-of-sight transmissions. Several types of towers are known in the prior art, including single-mast, multi-legged, and tapered monopole towers. Each tower has advantages and disadvantages ranging from cost to suitability of location site.

Typical installations for antenna support towers provide a prepared foundation for anchoring the tower to a support surface. For a single-mast tower, the entire tower may rest on one concrete foundation, the tower remaining upright through the use of radially-extending guy wires anchored to the support surface. A tapered monopole tower typically stands on a concrete column embedded in the support surface to act as a moment base for keeping the tower upright.

A multi-legged tower does not need guy wires to remain upright, instead having a base of at least three legs to transfer rotational loadings to the support surface. The support surface is typically concrete pads installed under each leg of the tower. In the case of each type of tower, a security fence is usually erected around the installation site.

Because of the installation requirements of prepared surfaces, fences, guy wires, etc., the time needed for a conventional tower installation is lengthy. Often, a tower needs to deployed quickly, but the typical installations do not permit rapid construction. Thus, there is a need for tower foundations that require less preparation of the site and reduce antenna support tower installation time.

SUMMARY OF THE INVENTION

The invention is an easily-constructed foundation for an antenna support tower. No fabricated support surface is needed at the installation site.

The foundation comprises a radial array of pre-fabricated buildings connected near their inner comers to each other. In a first embodiment, one leg of a multi-legged tower rests on each building, the buildings transferring forces from the tower to the support surface below the buildings. The buildings raise the base of the tower above the support surface, possibly negating the need for a fence around the installation site.

In a second embodiment, a tapered monopole tower is located in the center of the array of buildings. The monopole tower may sit on a prepared surface or may be supported above the support surface. The buildings are connected to each other at their comers, and support structures are attached at the same connection points, one support structure above the other. The support structures comprise a central ring and radially extending arms. The monopole tower is positioned within the central ring, transferring lateral loads through the ring and arms to the buildings. Guy wires are not necessary to keep the tower upright.

DESCRIPTION OF THE DRAWINGS

The novel features believed to be characteristic of the invention are set forth in the appended claims. The invention itself however, as well as a preferred mode of use, further objects, and advantages thereof, will best be understood by reference to the following detailed description of an illustrative embodiment when read in conjunction with the accompanying drawings.

DESCRIPTION OF THE INVENTION

Figure 1:
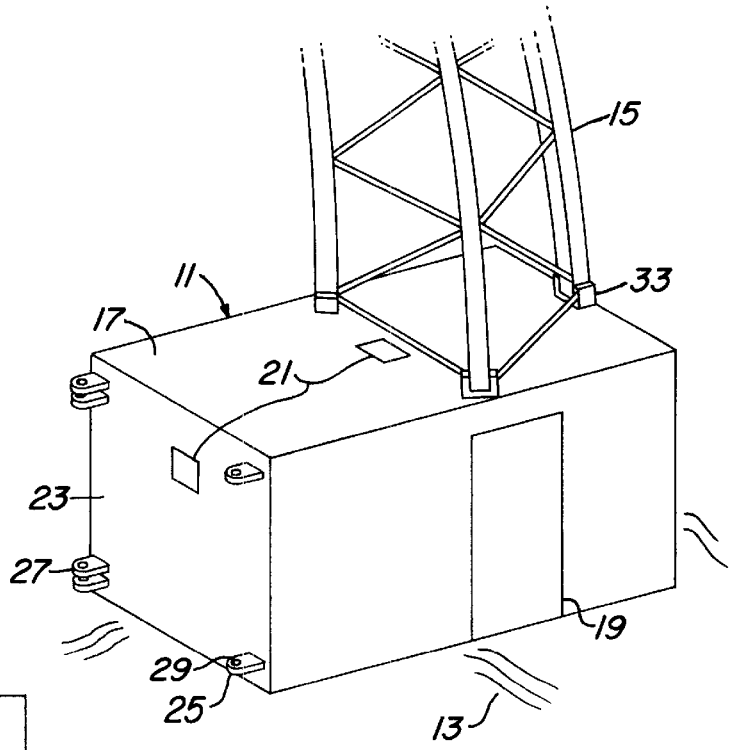
FIG. 1 is a perspective view of a building constructed in accordance with the invention and shows a tower leg attached to the leg attachments.

FIGS. 1 through 5 in the drawings illustrate the preferred embodiments of a prefabricated-building tower foundation according to the present invention.

Referring to FIG. 1, building 11 rests on support surface 13 with one leg 15 of a multi-leg antenna support tower attached to the upper surface 17. The building 11 is constructed of steel-reinforced concrete and is rectangular with a door 19 on one side. Bulkhead connectors 21 are located on the vertical inwardly-facing surface 23 and horizontal upper surface 17 and are used for attaching data and power cables running to the tower. Tang 25 and clevis 27 building connectors are located on the inwardly-facing surface 23 and are used to connect a set of buildings 11 in a radial array. The connectors 25, 27 have vertical holes 29 allowing the tangs 25 to be retained within the clevises 27 when a bolt 31 or other shaft is inserted into the aligned holes 29. Leg attachments 33 are used to secure the lower end of a tower leg 15 to the building 11. The buildings 11 are constructed with a length which places the leg attachments 33 a distance from the center of the array corresponding to the position of a leg 15 for a given tower.

The set of buildings 11 is connected in a radial array using the building connectors 25, 27 and forming a tower foundation 35. The foundation 35, illustrated in plan view in FIG. 2, includes three buildings 11 and is used to support a tower having three legs 13. Each building 11 is an enclosure resting on a support surface 13, which may be leveled earth with a layer of sand. The longitudinal axes of the buildings 11 are radially arrayed at angular increments of 120 degrees, and the buildings 11 are connected using tang 25 and clevis 27 building connectors 25, 27 located on the inwardly-facing surface 23. The building connectors 25, 27 are located a horizontal distance from the vertical edge 37 that allows the buildings 11 to be connected without causing mechanical interference between the vertical edges 37. The buildings 11 support the weight of the tower and limit motion of the tower by communicating axial and lateral forces from the legs 13 to the support surface 13

Figure 3:
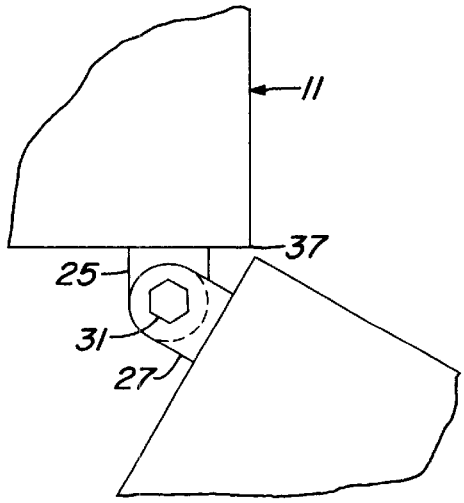
FIG. 3 is an enlarged plan view of the building connectors and constructed in accordance with the invention and shows connectors in their assembled configuration.

An enlargement in plan view of the assembled building connectors 25, 27 is seen in FIG. 3. The vertical edges 37 of two adjacent buildings 11 are placed in close proximity. The tang 25 located on one building 11 is inserted into the clevis 27 of the adjacent building 11, and a bolt 31 is inserted into the aligned holes 29 for retaining the tang 25 within the clevis 27. The connectors 25, 27 are located a horizontal distance from the vertical edges 37 that allows for the buildings 11 to be assembled in an array without mechanical interference between the edges 37.

Figure 2:
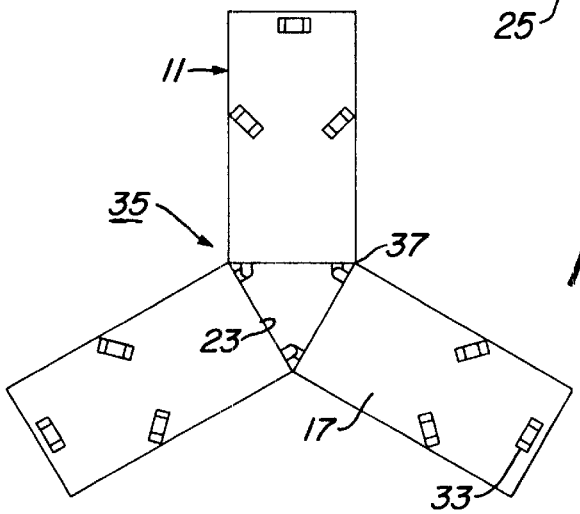
FIG. 2 is a plan view of three buildings constructed in accordance with the invention and connected to form a radial array.

Referring to FIGS. 1 through 3, assembly of the foundation 35 is accomplished by installing the three buildings 11 in a radial array. Buildings 11 are placed with their inwardly-facing surfaces 16 facing the center of the desired array. The tangs 25 located near the edges 37 of one building 11 are inserted within the devises 27 located on the adjacent building 11. Bolts 29 or other shafts are inserted into the aligned connector holes 29 to retain the tangs 25 within the devises 27. One of the tower legs 13 is secured to leg attachments 33 on each of the buildings 11. The remaining tower portions are erected on the legs 13.

Figure 4:
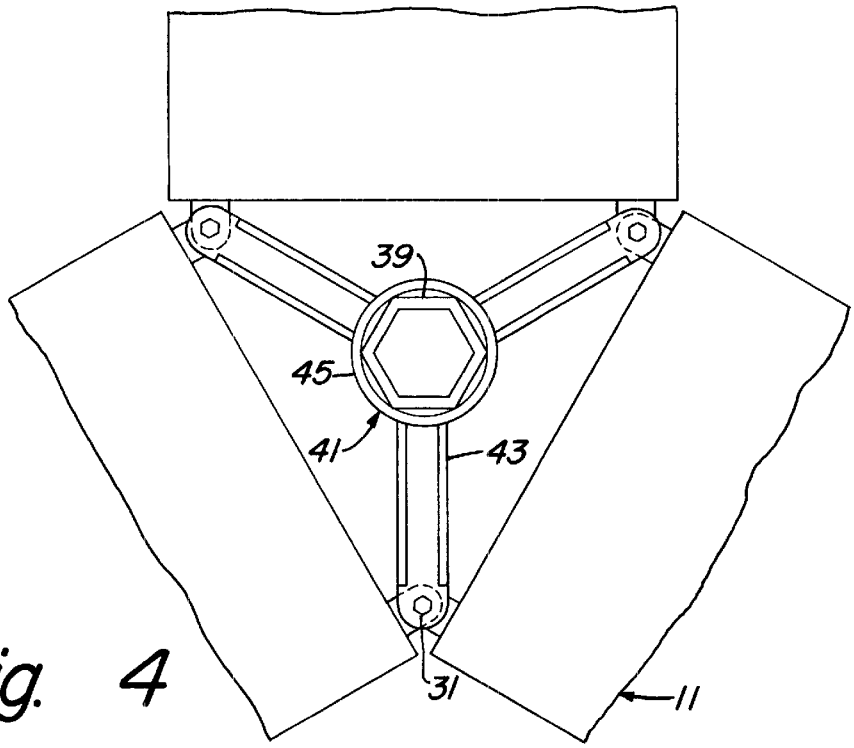
FIG. 4 is an enlarged plan view of three buildings and a central support structure constructed in accordance with the invention and shown in their assembled configuration with a single-pole tower installed.

An alternative embodiment of the invention for use with a single-pole, or monopole, tower 39 is illustrated in plan view in FIG. 4. Three buildings 11 are assembled to form a foundation 35 as described above. A set of support structures 41 having radially-extending arms 43 with tang connectors at the outer end of each arm 43 are attached to the foundation 35 at the building connectors 25, 27. Each support structure 41 has a central ring 45 from which the radial arms 43 extend. A tapered polygonal single-pole tower (shown) or a tapered cylindrical single-pole tower is located within and at the center of the radial array of buildings 11, and the lower portion of the tower 39 is placed within the central rings 45 of the support structures 41. A support surface 13 supports the weight of the tower 39 and prevents lateral motion of the base of the tower 39. Lateral loads on the tower 39 are transferred through the ring 45 and arms 43 to the foundation 35. Alternatively, though not shown in the figures, the support structures 41 may support the tower 39 above the support surface 13.

Figure 5:
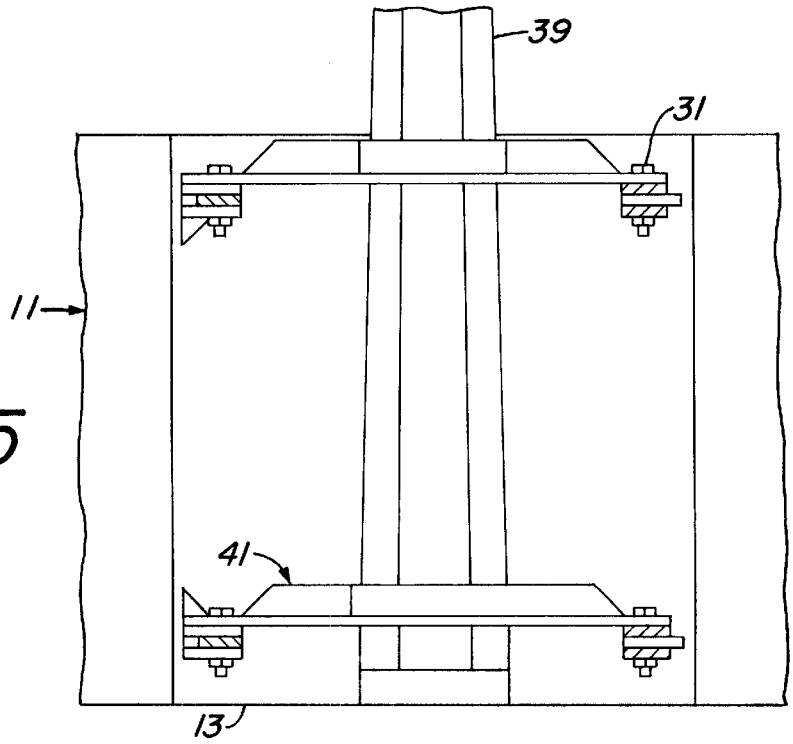
FIG. 5 is an enlarged profile view of the central support structures and building connectors constructed in accordance with the invention and shown in their assembled configuration with a single-pole tower installed.

FIG. 5 is a profile view of the foundation 35 and support structures 41 for single-pole tower 39. The two support structures 41 are connected to the foundation 35 by attaching the tangs at the ends of the arms 43 to the assembled building connectors 25, 27. The tangs have vertical holes that are aligned with those of the building connectors 25, 27, and a bolt 31 is inserted into the aligned holes 29. The lower portion of a polygonal single-pole tower 39 is shown installed within the central rings 45 of the support structures 41. The tower 39 base is shown as being supported by the support surface 13. Alternatively, the support structures 41 may support the tower 39 base above the support surface 13.

Referring to FIGS. 4 and 5, setup for a polygonal or cylindrical single-pole tower 39 uses a foundation 35 as previously described in connection with the first embodiment. Support structures 41 are installed by attaching tang connectors at the outer end of radially extending arms 43 to the foundation 35 at the building connectors 25, 27. Tower 39 is assembled with its lower portion located within the central ring 45 of the support structures 41.

While the invention has been shown in only some of its forms, it is not thus limited but is susceptible to various changes and modifications without departing from the spirit thereof.

I claim:

1. A telecommunications installation, comprising:

a plurality of buildings, each of the buildings having an interior for containing telecommunications equipment, the buildings being connected to each other and in an array; and an antenna support tower mounted to and being supported by the array.

2. The installation of claim 1, wherein:

the array has an axis, with each of the buildings extending radially therefrom; and the tower extends upward concentric with the axis.

3. The installation of claim 1, wherein:

the buildings of the array support the weight of the tower.

4. The installation of claim 1, wherein:

the buildings of the array provide lateral support to the tower.

5. The installation of claim 1, wherein:

the tower has a plurality of legs: and the installation further comprises:

leg attachments located on an upper surface of each of the buildings, each leg attachment receiving an securing a lower portion one of the legs of the tower, so that the weight of the tower is supported by the buildings.

6. The installation of claim 1, wherein:

array has an axis, with the buildings extending radially therefrom, defining a central opening between the buildings; and the tower has a lower end located concentrically on the axis within the central opening; and the installation further comprises:

a plurality of arms, each extending inward from one of the buildings into the central opening and into engagement with the tower to provide lateral support.

7. The installation of claim 1, wherein the weight of the tower bypasses the buildings and passes directly to a supporting surface in the central opening.

8. The installation of claim 1, wherein:

the array has an axis, with the buildings extending radially therefrom; and the installation further comprises:

a ring located concentrically on the axis and connected to the buildings by a plurality of arms, each extending radially inward from one of the buildings to the rings; and wherein the tower has a lower end located concentrically on the axis, the tower extending through the ring.

9. The installation of claim 1, wherein each of the buildings has an inner end wall and two side walls, defining comers between each of the inner end walls and the side walls, and wherein the inner end walls face each other, and the comers of the buildings are secured to the comers of the other buildings by lugs.

10. The installation of claim 1, wherein each of the buildings has a top, side walls, and end walls constructed of steel-reinforced concrete.

11. A foundation for a multi-legged tower, comprising:

plurality of buildings arranged in an array, the buildings being rigidly connected to each other to form a weight supporting foundation for the tower, each of the buildings having an interior for containing telecommunications equipment; and leg attachments mounted on an upper surface of each of the buildings, each leg attachment being adapted to receive a lower portion of one leg of the tower, so that a portion of the weight of the tower passes through each of the buildings.

12. The foundation of claim 11, wherein:

the array of buildings comprises three buildings, each of the buildings having an inner end wall and two side walls, defining comers at an intersection between the inner end walls and the side walls, and wherein the inner end walls define a triangular opening between the buildings.

13. The foundation of claim 11, wherein:

the array defines a triangular opening with a central axis, and each of the buildings has comers oriented toward the central axis, and the buildings are connected to each other using tang and clevis connectors located adjacent each of the comers.

14. The foundation of claim 11, wherein each of the buildings has side walls and end walls constructed of steel-reinforced concrete.

15. A foundation for a tower, comprising:

a plurality of buildings arranged in an array that defines a central opening between the buildings for receiving a lower portion of the tower, the buildings being rigidly connected each other, each of the buildings having an interior adapted to receive telecommunications equipment; and a plurality of arms, each extending inward into the central opening from one of the buildings for engaging the tower to provide lateral support.

16. The foundation according to claim 15, further comprising:

a central ring supported in the central opening by the arms, the central ring adapted to receive the tower.

17. The foundation according to claim 15, wherein the central opening is triangular in configuration.

18. The foundation according to claim 15, wherein:

the buildings have comers located at the central opening, and the buildings are connected to each other using tang and clevis connectors located near the comers of the buildings.

19. The foundation according to claim 15, wherein the arms are configured to transmit only lateral loads imposed by the tower to the buildings.

20. The foundation of claim 15, wherein each of the buildings has side walls and end walls constructed of steel-reinforced concrete.

* * * * *